US008857949B2

(12) United States Patent
Seino et al.

(10) Patent No.: US 8,857,949 B2
(45) Date of Patent: Oct. 14, 2014

(54) LIQUID EJECTING APPARATUS AND MAINTENANCE METHOD FOR A LIQUID EJECTING APPARATUS

(75) Inventors: Takeo Seino, Matsumoto (JP); Taisuke Yamamoto, Shiojiri (JP); Shuhei Harada, Chino (JP); Naoyoshi Hashimoto, Shiojiri (JP); Yoshihiro Koizumi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 552 days.

(21) Appl. No.: 12/726,124

(22) Filed: Mar. 17, 2010

(65) Prior Publication Data

US 2010/0245462 A1 Sep. 30, 2010

(30) Foreign Application Priority Data

Mar. 26, 2009 (JP) ..... 2009-077009

(51) Int. Cl.
*B41J 2/165* (2006.01)

(52) U.S. Cl.
CPC ..... *B41J 2/16544* (2013.01); *B41J 2/16541* (2013.01)
USPC ..... 347/31

(58) Field of Classification Search
None
See application file for complete search history.

(56) References Cited

U.S. PATENT DOCUMENTS

2003/0218652 A1* 11/2003 Nakashima ..... 347/31
2008/0012896 A1* 1/2008 Murayama ..... 347/31

FOREIGN PATENT DOCUMENTS

JP 06-143597 5/1994

* cited by examiner

*Primary Examiner* — Alejandro Valencia
(74) *Attorney, Agent, or Firm* — Workman Nydegger

(57) ABSTRACT

A liquid ejecting apparatus includes a liquid ejecting head having a nozzle formation surface with a nozzle that discharges a liquid. A cleaning member wipes the nozzle formation surface to remove liquid that has adhered thereto. An absorption member of a porous material deforms under pressure and includes an absorption surface that contacts the cleaning member to absorb liquid that has adhered thereto. A pressure member moves between a pressure position, in which the pressure member applies pressure to the absorption surface of the absorption member, and a non-pressure position, in which the pressure member does not apply pressure to the absorption surface. A movement mechanism moves the pressure member from the non-pressure position to the pressure position to cause the absorption member to deform, thereby dispersing the liquid absorbed by the absorption member from the cleaning member via the absorption surface into the interior of the absorption member.

12 Claims, 5 Drawing Sheets

LIQUID EJECTING APPARATUS AND MAINTENANCE METHOD FOR A LIQUID EJECTING APPARATUS

BACKGROUND

1. Technical Field

The present invention relates to a liquid ejecting apparatus and a maintenance method for a liquid ejecting apparatus.

2. Related Art

Generally speaking, ink jet recording apparatuses, which are a type of liquid ejecting apparatus, include a recording head (liquid ejecting head), and a nozzle that ejects ink (the liquid) is formed in a nozzle formation surface in the recording head. Because the recording head prints by discharging pressurized ink from the nozzle onto a recording sheet (a recording medium) as ink droplets, there are cases where when ink is discharged onto the recording surface of the recording sheet, the discharged ink splashes back from the recording surface of the recording sheet and adheres to the nozzle formation surface of the recording head. Meanwhile, when cleaning the recording head in order to suppress clogs in the nozzle opening and so on, ink forcibly discharged from the nozzle collects within a cap that makes contact with the nozzle formation surface, and thus there are cases where ink adheres to the nozzle formation surface. In order to wipe away ink that has adhered to the nozzle formation surface in this manner, a wiper (cleaning member) configured of a flexible rubber elastic member is provided, and the nozzle formation surface of the recording head is cleaned by sliding the tip portion of the wiper across the nozzle formation surface of the recording head, thereby wiping off the nozzle formation surface.

Incidentally, when wiping the nozzle formation surface of the recording head using the wiper, the ink removed from the nozzle formation surface by the wiping adheres to the tip portion of the wiper. There is thus a problem in that if the nozzle formation surface is then wiped for cleaning by the wiper in such a state where ink adheres to the tip portion of the wiper, the ink that adheres to the tip portion of the wiper will once again adhere to the nozzle formation surface. JP-A-6-143597, for example, proposes a head surface (nozzle formation surface) cleaning apparatus for a recording head in order to avoid this problem.

With the head surface cleaning apparatus for a recording head according to JP-A-6-143597, a wiper is attached to a slider having a rack (toothed portion); the rack of the slider is interlocked with a pinion, and by transferring rotational movement from a driving source to the pinion, the slider is caused to make back-and-forth movements, thereby causing the wiper to make back-and-forth movements in a linear direction. Furthermore, an absorption member, configured of a porous material and having an absorption surface that is capable of making contact with the tip portion of the wiper after the wiper has wiped the nozzle formation surface of the recording head, is disposed within the back-and-forth direction of the wiper. When cleaning the head surface of the recording head, the wiper is moved back and forth, thereby wiping off ink that has adhered to the head surface; furthermore, the tip portion of the wiper to which ink has adhered as a result of the aforementioned wiping is slid across the absorption surface of the absorption member, and the ink that has adhered to the tip portion of the wiper is absorbed by the absorption member as a result.

Incidentally, with the head surface cleaning apparatus for a recording head according to JP-A-6-143597, when the tip portion of the wiper is slid across the absorption surface of the absorption member in a state in which ink adheres to the wiper and the ink that was present on the tip portion of the wiper adheres to the absorption surface of the absorption member as a result, the ink that adheres to the absorption surface has sometimes dried and hardened on that absorption surface. If the ink that adheres to the absorption surface in this manner hardens and collects on the absorption surface, the porous absorption member will experience clogs due to the collected ink in the absorption surface on which the ink has collected, resulting in a risk that it will become difficult for the absorption member to absorb ink adhering to the tip portion of the wiper.

SUMMARY

An advantage of some aspects of the invention is to provide a liquid ejecting apparatus and maintenance method for a liquid ejecting apparatus capable of maintaining favorable cleaning functionality and liquid ejecting functionality by avoiding a situation in which an absorption surface of an absorption member that absorbs liquid adhering to a cleaning member becomes clogged.

A liquid ejecting apparatus according to an aspect of the invention includes: a liquid ejecting head having a nozzle formation surface in which a nozzle that discharges a liquid is formed; a cleaning member that wipes the nozzle formation surface in order to remove liquid that has adhered to the nozzle formation surface; an absorption member, configured of a porous material capable of deforming under pressure, including an absorption surface that makes contact with the cleaning member in order to absorb liquid that has adhered to the cleaning member; a pressure member capable of moving between a pressure position, in which the pressure member applies pressure to the absorption surface of the absorption member, and a non-pressure position, in which the pressure member cannot apply pressure to the absorption surface of the absorption member; and a movement mechanism that moves the pressure member from the non-pressure position toward the pressure position so as to cause the absorption member to deform in order to disperse the liquid absorbed by the absorption member from the cleaning member via the absorption surface into the interior of the absorption member.

According to this aspect of the invention, after liquid adhering to the cleaning member is absorbed by the absorption surface of the absorption member, the movement mechanism moves the pressure member from the non-pressure position to the pressure position, and pressure is applied to the absorption surface of the absorption member by the pressure member; as a result, the liquid adhering to the absorption surface of the absorption member is dispersed into the absorption member in accordance with the deformation of the absorption member. Accordingly, the liquid absorbed by the absorption member from the cleaning member via the absorption surface and still adhering to the absorption surface can be suppressed from hardening and accumulating thereupon, and thus favorable cleaning functionality and liquid ejecting functionality can be maintained by avoiding a situation in which the absorption surface of the absorption member becomes clogged.

According to another aspect of the invention, in the liquid ejecting apparatus, the interior of the absorption member is held in a moist state by a cleaning liquid.

According to this aspect of the invention, when the liquid is dispersed into the absorption member configured of a porous material by using the pressure member to apply pressure to the absorption surface to which the liquid adheres and deforms, the interior of the porous material is held in a moist state by the cleaning liquid, which makes it possible to smoothly disperse the liquid adhering to the absorption surface into the porous material.

According to another aspect of the invention, in the liquid ejecting apparatus, the cleaning liquid is a non-volatile liquid.

According to this aspect of the invention, a non-volatile liquid does not easily evaporate and is therefore long-lasting; the liquid is thus well-suited to maintaining the absorption member in a moist state. Furthermore, a higher osmotic force than with volatile liquids can be expected from the non-volatile liquid, and it is thus easy to realize the effects of dispersing the liquid throughout the absorption member.

According to another aspect of the invention, in the liquid ejecting apparatus, the pressure member stands by in the non-pressure position, separated from the absorption member, other than when a pressurizing operation in which the movement mechanism moves the pressure member from the non-pressure position toward the pressure position in order to apply pressure to the absorption member is carried out.

According to this aspect of the invention, a state in which the absorption member and the pressure member make contact with each other for a long period of time can be avoided, and a situation in which the portions of the absorption member and the pressure member that make contact with each other stick to each other due to the liquid adhering to the absorption surface of the absorption member can be suppressed. Furthermore, a situation in which the absorption member becomes permanently deformed due to the pressure member applying pressure to the absorption member for long periods of time can be suppressed as well.

According to another aspect of the invention, in the liquid ejecting apparatus, the pressure member is configured of a porous material whose interior is held in a moist state by the cleaning liquid.

According to this aspect of the invention, when the pressure member applies pressure to the absorption member, the cleaning liquid within the pressure member is absorbed by the absorption member. The absorption member can thus be held in an even moister state. Meanwhile, the liquid that has been dispersed throughout the absorption member due to the pressure member applying pressure to the absorption member is absorbed into the pressure member, which is configured of a porous material and is held in a moist state by the cleaning liquid. A state in which the absorption surface of the absorption member becomes clogged can thus be avoided even more effectively.

According to another aspect of the invention, in the liquid ejecting apparatus, a pressurizing operation in which the movement mechanism moves the pressure member from the non-pressure position toward the pressure position in order to apply pressure to the absorption member is executed multiple times.

According to this aspect of the invention, executing the pressurizing operations for applying pressure to the absorption member using the pressure member multiple times makes it possible for the liquid that has adhered to the absorption surface of the absorption member to more easily disperse into the absorption member configured of a porous material, as opposed to when the pressurizing operations are executed only once.

A maintenance method for a liquid ejecting apparatus according to another aspect of the invention includes: wiping a nozzle formation surface, in which a nozzle for discharging a liquid in a liquid ejecting head is formed, with a cleaning member in order to remove liquid that has adhered to the nozzle formation surface; causing an absorption surface of an absorption member, configured of a porous material for absorbing liquid that has adhered to the cleaning member, to make contact with the cleaning member; moving a pressure member between a pressure position, in which the pressure member applies pressure to the absorption surface of the absorption member, and a non-pressure position, in which the pressure member cannot apply pressure to the absorption surface of the absorption member; and using the pressure member to apply pressure to the absorption surface of the absorption member that has absorbed liquid from the cleaning member via the absorption surface in order to disperse the liquid into the absorption member. According to this aspect of the invention, the same effects as those provided by the aforementioned liquid ejecting apparatus can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a specific embodiment of an ink jet printer, serving as a type of a liquid ejecting apparatus according to the invention, will be described based on to the drawings. Note that in the following descriptions, the terms "depth direction", "vertical direction", and "horizontal direction" are assumed to refer to the "front", "top", and "right", respectively, illustrated by the arrows shown in FIG. 1, unless otherwise specified.

Figure 1:
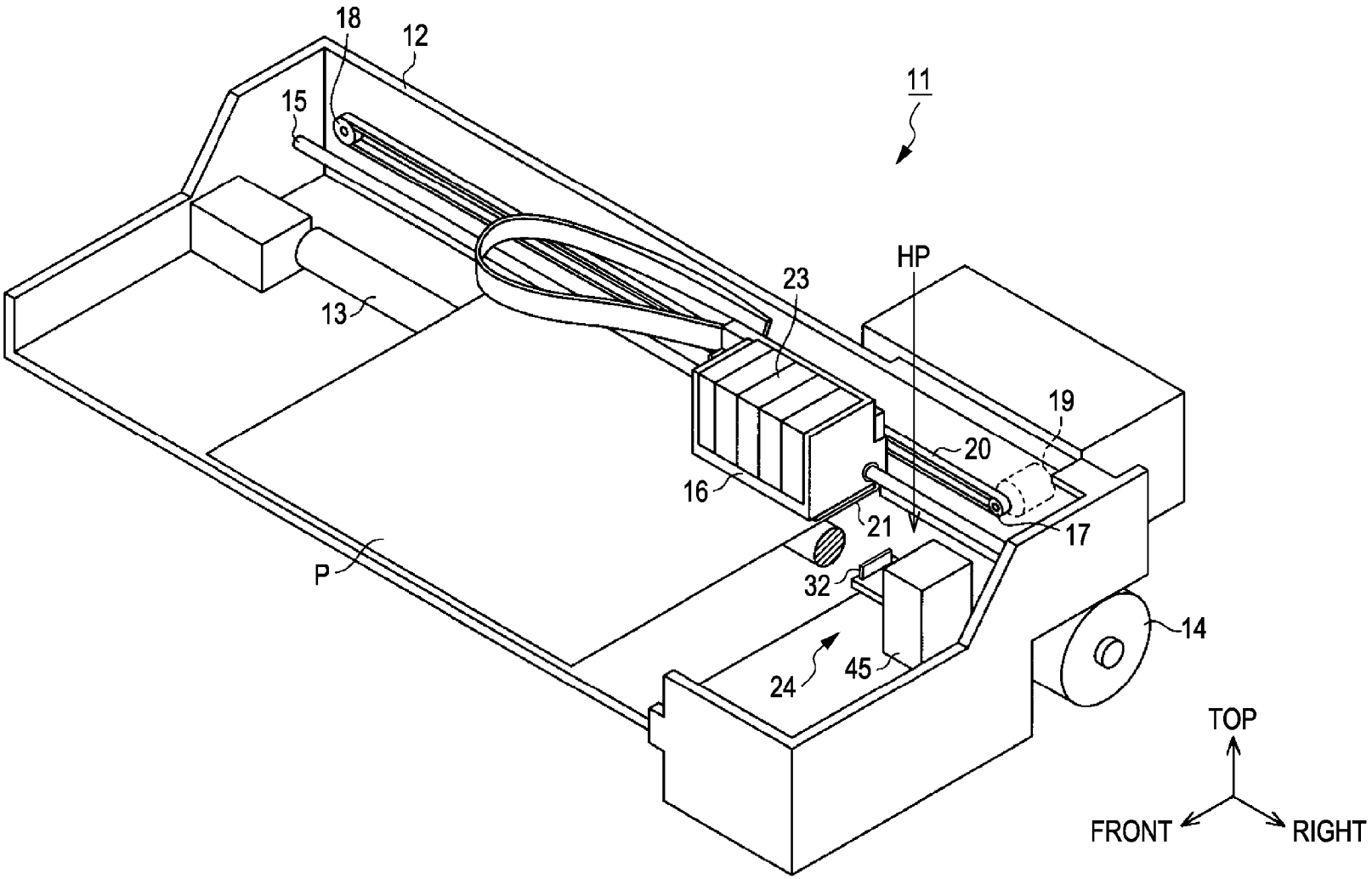
FIG. 1 is a perspective view of an ink jet printer according to an embodiment of the invention.

As shown in FIG. 1, the ink jet printer (called simply a "printer" hereinafter) 11 serving as a liquid ejecting apparatus according to this embodiment is provided with a frame 12, which is in a rectangular shape when viewed from above. A platen 13 extends in the horizontal direction within the frame 12, and a recording sheet P, serving as a recording medium, is supplied from the rear side to the front side on the platen 13 by a paper transport mechanism having a paper transport motor 14. Furthermore, a guide shaft 15 is provided above the platen 13 within the frame 12 extending parallel to the lengthwise direction of the platen 13 (the horizontal direction).

A carriage 16 is supported by the guide shaft 15 so as to be capable of back-and-forth movement along the axial direction of the guide shaft 15 (the horizontal direction). A recording head 21, serving as a liquid ejecting head, is provided on the bottom surface of the carriage 16, whereas multiple (in this embodiment, five) ink cartridges 23, for supplying ink, which is an example of a liquid, to the recording head 21, are installed in the top of the carriage 16 in a removable state. The recording head 21 has a rectangular shape when viewed from above.

Figure 2:
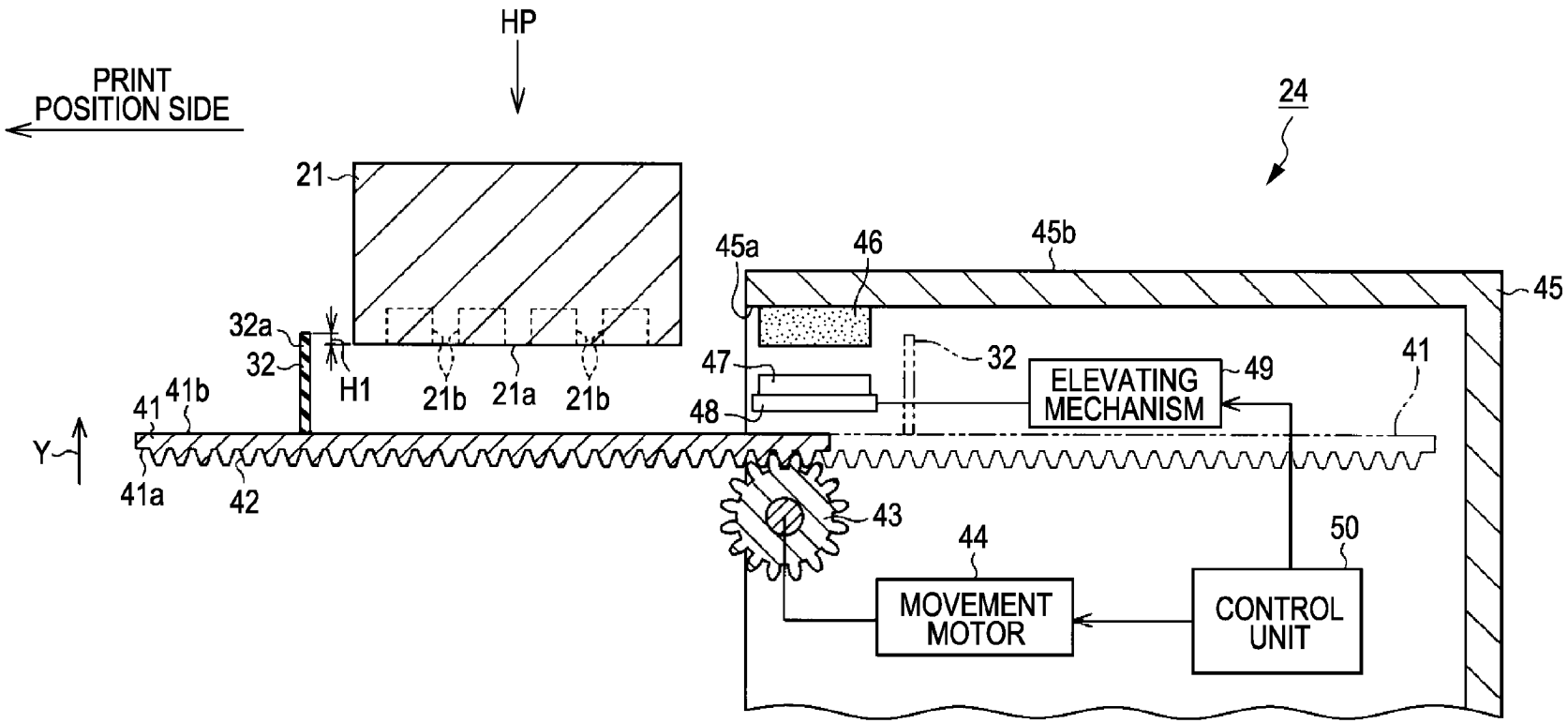
FIG. 2 is a schematic view of a vertical cross-section of a maintenance unit in which a recording head is in a home position and a wiper is in a state prior to wiping a nozzle formation surface.

As shown in FIG. 2, multiple nozzles 21*b* are formed in a nozzle formation surface 21*a* configured on the bottom surface of the recording head 21, and the configuration is such that each nozzle 21*b* corresponds to a respective ink cartridge 23, with ink being supplied to the individual nozzles 21*b* via corresponding ink channels (not shown) formed in the recording head 21.

As shown in FIG. 1, a driving pulley 17 and a slave pulley 18 are supported on the back surface of the frame 12 in a rotatable state in locations corresponding to the respective ends of the guide shaft 15. A carriage motor 19, serving as the driving source when the carriage 16 moves back and forth, is connected to the driving pulley 17, and a timing belt 20 that supports the carriage 16 in a fixed state is stretched across the pair of pulleys 17 and 18. Accordingly, the recording head 21 provided in the carriage 16 can move via the timing belt 20 between a printing position in which printing is performed by discharging ink onto the recording sheet P and a home position HP provided on one end within the frame 12 (the right side, in FIG. 1) by being driven by the carriage motor 19 while being guided by the guide shaft 15. The "printing position" mentioned here refers to a liquid ejecting position in which ink is ejected onto the recording sheet P, whereas the "home position HP" refers to a maintenance position in which the recording head 21 is positioned when the printer 11 is off, when maintenance is to be performed on the recording head 21, and so on.

A maintenance unit 24 that carries out various types of maintenance is provided below the location corresponding to the home position HP, so as to maintain the ink ejection from the recording head 21 onto the recording sheet P in a favorable state.

The maintenance unit 24 includes a cap (not shown) corresponding to the nozzle formation surface 21*a* of the recording head 21, and an elevation device (not shown) for elevating the cap. The cap is provided so as to make contact with the nozzle formation surface 21*a* while surrounding the nozzles 21*b* upon being elevated based on the driving of the elevation device, in a state where the recording head 21 has moved to the home position HP. The recording head 21 is cleaned by depressurizing the space within the cap in this state through the driving of a suction pump (not shown), which sucks and expulses ink from the nozzles 21*b*.

As shown in FIG. 2, the maintenance unit 24 is provided with a strip plate 41 that is longer than the recording head 21 in the lengthwise direction thereof (in FIG. 2, the horizontal direction), and a rack 42 is formed in the bottom surface of the strip plate 41 along the lengthwise direction thereof (in FIG. 2, the horizontal direction). A pinion 43, which rotates central to an axial line following the direction perpendicular to the lengthwise direction of the strip plate 41, interlocks with the rack 42 of the strip plate 41.

A wiper 32, serving as a cleaning member, is erected in the direction vertical to an upper surface 41*b* of the strip plate 41 on the printing position side of the upper surface 41*b* of the strip plate 41. The wiper 32 is configured of an elastic material (for example, natural or synthetic rubber) and is formed in a strip shape. Note that the width of the wiper 32 in the direction perpendicular to the lengthwise direction of the nozzle formation surface 21*a* of the recording head 21 is greater than the width of the recording head 21 in the direction perpendicular to the lengthwise direction of the nozzle formation surface 21*a*.

The maintenance unit 24 is provided with a housing 45 having an open surface on the side of the maintenance unit (the surface on the printing position side) that is located toward the home position (that is, the side opposite to the printing position, or in FIG. 1, the right side). The housing 45 is of a size that allows the strip plate 41 to enter into the housing 45 via an opening portion 45*a*. A plate-shaped absorption member 46 configured of a porous material such as, for example, urethane foam or the like, is affixed to the inside surface of an upper wall 45*b* of which housing 45 is formed. The bottom surface of the absorption member 46 is provided so as to be of the same height as the height at which the nozzle formation surface 21*a* is positioned when the recording head 21 is positioned in the home position HP.

Cleaning liquid is effused to the absorption member 46 via a cleaning liquid supply tube (not shown), and thus the absorption member 46 is held in a moist state. Note that in this embodiment, a non-volatile liquid is used as the cleaning liquid. It is preferable to use, for example, glycerin, diethylene glycol, propylene glycol, or the like as the non-volatile liquid.

A plate-shaped pressure member 47, configured of a porous material such as, for example, urethane foam, is disposed within the housing 45. As with the stated absorption member 46, cleaning liquid is effused to the pressure member 47 via a cleaning liquid supply tube (not shown), and thus the pressure member 47 is held in a moist state. The pressure member 47 is supported by a support member 48 connected to an elevating mechanism 49 serving as a movement mechanism. The pressure member 47 supported by the support member 48 is capable of moving in the upward direction toward the absorption member 46 as a result of the elevating mechanism 49 being controlled to elevate by a control unit 50 provided in the maintenance unit 24.

A movement motor 44 is connected to the pinion 43 so as to be capable of transferring driving force thereto, and the movement motor 44 is controlled by the control unit 50 so as to rotate in both the forward and reverse directions. Note that the movement motor 44 is also used as the motor serving as, for example, the driving source of the suction pump. The driving of the movement motor 44 causes the pinion 43 to rotate, causing the strip plate 41, which is in a state where the rack 42 thereof is interlocked with the pinion 43, to move back and forth between the position indicated by the solid line in FIG. 2 and a position within the housing 45 indicated by the double-dot-dash line in FIG. 2, while maintaining its horizontal state. Note that the strip plate 41 is also capable of being moved in the vertical direction by the pinion 43 and the elevating mechanism (not shown) in a state in which the rack 42 thereof and the pinion 43 are interlocked.

Next, operations of the maintenance unit 24 will be described.

As shown in FIG. 2, when the recording head 21 is positioned at the home position HP, first, the strip plate 41 is moved in the upward direction (the direction of the arrow Y in FIG. 2) by the elevating mechanism (not shown). At this time, the elevating mechanism moves the strip plate 41 in the upward direction so that the position of a tip portion 32*a* of the wiper 32 is higher than the nozzle formation surface 21*a* of the recording head 21 by a height H1.

Figure 3:
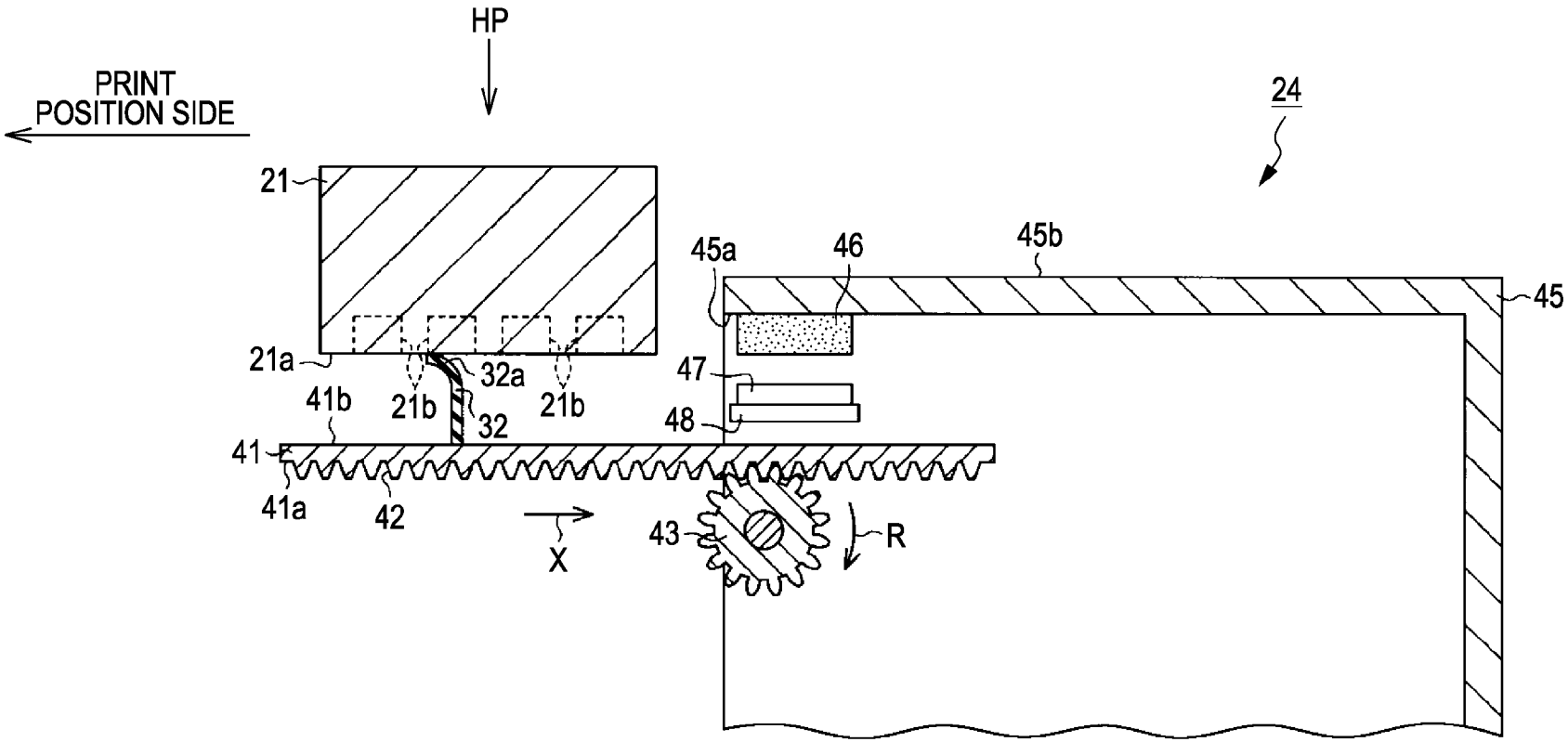
FIG. 3 is a schematic view of a vertical cross-section of a maintenance unit in which a tip portion of a wiper and a nozzle formation surface are in a sliding state.

In this state, when the pinion 43 is rotated in the clockwise direction (the direction of the arrow R shown in FIG. 3) by the driving of the movement motor 44, as shown in FIG. 3, the strip plate 41 moves horizontally toward the interior of the housing 45 (the direction of the arrow X shown in FIG. 3). Upon doing so, the wiper 32 moves relative to the recording head 21 in the horizontal direction so that the tip portion 32*a* thereof slides across the nozzle formation surface 21*a* of the recording head 21 while deforming elastically. Accordingly, the nozzle formation surface 21*a* is wiped clean of ink that has adhered thereto by the wiper 32 (a process of cleaning).

Figure 4:
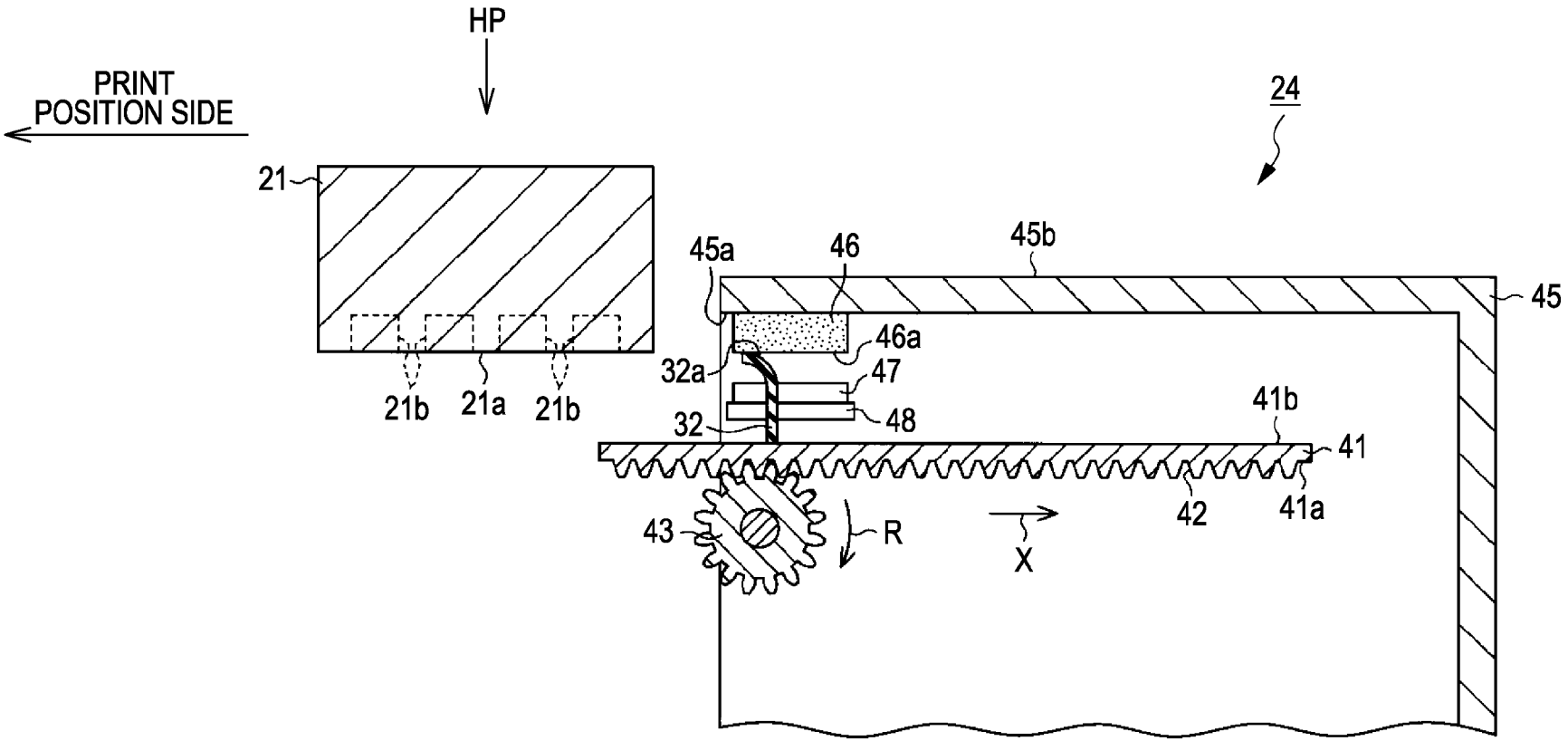
FIG. 4 is a schematic view of a vertical cross-section of a maintenance unit in which a tip portion of a wiper and an absorption surface of an absorption member are in a sliding state.

Meanwhile, when the nozzle formation surface 21*a* of the recording head 21 is cleaned by the wiper 32, the ink wiped by the tip portion 32*a* of the wiper 32 adheres to the tip portion 32*a*. In order to remove the ink that has adhered to the tip portion 32*a* of the wiper 32, as shown in FIG. 4, the pinion 43 is rotated further in the clockwise direction (the direction of the arrow R shown in FIG. 4) by the driving of the movement motor 44. Upon doing so, the strip plate 41 moves horizontally further into the housing 45 (the direction of the arrow X shown in FIG. 4). The tip portion 32*a* of the wiper 32 moves relative to the absorption member 46 in the horizontal direction so as to slide across an absorption surface 46*a* configured on the bottom surface of the absorption member 46. Accordingly, the ink adhering to the tip portion 32*a* of the wiper 32 is absorbed by the absorption member 46 through the absorption surface 46*a* of the absorption member 46, thereby cleaning the tip portion 32*a* of the wiper 32 (a process of absorbing).

Figure 5:
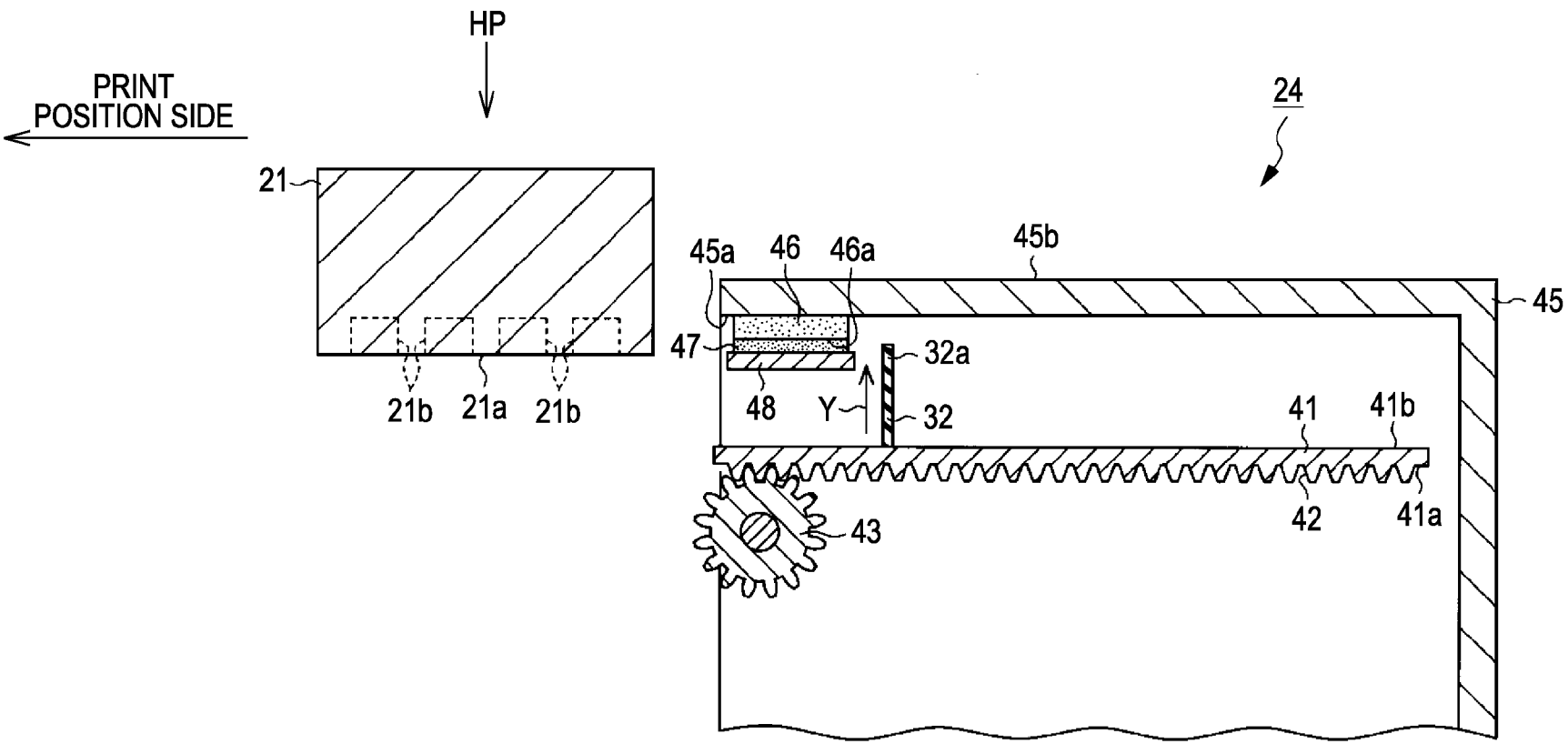
FIG. 5 is a schematic view of a vertical cross-section of a maintenance unit illustrating a state in which an absorption member is being pressed by a pressure member.

Next, as shown in FIG. 5, in a state in which the tip portion 32*a* of the wiper 32 has been cleaned by the absorption member 46, the support member 48 is moved upward (the direction of the arrow Y shown in FIG. 5) toward the absorption member 46 by the elevating mechanism 49. Upon doing so, the pressure member 47 supported by the support member 48 moved upward toward the absorption member 46, and the surface of the pressure member 47 that opposes the absorption surface 46*a* of the absorption member 46 makes contact with the absorption surface 46*a* of the absorption member 46. Note that the surface of the pressure member 47 that opposes the absorption surface 46*a* of the absorption member 46 has approximately the same surface area as the absorption surface 46*a* of the absorption member 46.

The elevating mechanism 49 then further moves the pressure member 47 in the upward direction toward a pressure position, in which the pressure member 47 is capable of applying pressure to the absorption member 46, and the pressure member 47 applies pressure to the absorption member 46, causing the absorption member 46 to deform. Upon doing so, the absorption member 46 deforms as a result of the pressure applied by the pressure member 47, and thus the ink adhering to the absorption surface 46*a* of the absorption member 46 is dispersed throughout the entirety of the absorption member 46, which is configured of a porous material held in a moist state by the cleaning liquid (a process of dispersing).

After the pressure member 47 has caused the ink adhering to the absorption surface 46*a* to disperse within the absorption member 46 by applying pressure to the absorption member 46 and causing the absorption member 46 to deform, the pressure member 47 is moved to below the pressure position by the elevating mechanism 49, and stands by in that original position (that is, the position prior to moving upward to apply pressure to the absorption member 46). In other words, the pressure member 47 stands by in a non-pressure position (see FIG. 2 to FIG. 4), which is a position that is lower than the pressure position in which pressure is applied to the absorption member 46 and in which the pressure member 47 is separated from the absorption member 46 and thus cannot apply pressure to the absorption member 46, when the pressurizing operations performed after the tip portion 32*a* of the wiper 32 has been cleaned by the absorption member 46 are not being carried out.

The following effects can be achieved by the aforementioned embodiment.

(1) Ink adhering to the tip portion 32*a* of the wiper 32 that wiped the nozzle formation surface 21*a* of the recording head 21 is absorbed by causing the absorption surface 46*a* of the absorption member 46 to make contact with the tip portion 32*a* of the wiper 32, after which the pressure member 47 is moved upward by the elevating mechanism 49 from a lower non-pressure position toward a pressure position in which the pressure member 47 can apply pressure to the absorption surface 46*a* of the absorption member 46. When pressure is applied to the absorption member 46, the ink adhering to the absorption surface 46*a* of the absorption member 46 is dispersed throughout the entirety of the absorption member 46, which is configured of a porous material. Accordingly, the ink absorbed by the absorption member from the tip portion 32*a* of the wiper 32 via the absorption surface 46*a* when the tip portion 32*a* of the wiper 32 and the absorption surface 46*a* of the absorption member 46 come into contact with each other can be suppressed from hardening while still adhering to the absorption surface 46*a* and accumulating thereupon. A state in which the absorption surface 46*a* of the absorption member 46, which absorbs ink adhering to the tip portion 32*a* of the wiper 32, clogs due to the ink adhering to the absorption surface 46*a* hardening and accumulating can therefore be avoided, making it possible to maintain the cleaning functionality of the wiper 32 and the liquid ejection functionality of the recording head 21 in favorable states. Furthermore, because the absorption member 46 configured of a porous material is held in a moist state due to the cleaning liquid, the ink can be dispersed in a smoother manner when the pressure member 47 applies pressure to the absorption member 46 and the absorption member 46 deforms.

(2) The cleaning liquid used to put the absorption member 46 and pressure member 47 in a moist state is a non-volatile liquid and does not easily evaporate, and is therefore long-lasting; the cleaning liquid is thus well-suited to maintaining the absorption member 46 and pressure member 47 in a moist state. Furthermore, a higher osmotic force than with volatile liquids can be expected from the cleaning liquid, and it is thus easy to realize the effects of dispersing the ink throughout the absorption member 46.

(3) When the pressurizing operations performed after the tip portion 32*a* of the wiper 32 has been cleaned by the absorption member 46 are not being carried out, the pressure member 47 is in the non-pressure position in which the pressure member 47 cannot apply pressure to the absorption surface 46*a* of the absorption member 46, with the absorption member 46 and pressure member 47 in a state in which they are separated from each other. Accordingly, a state in which the absorption member 46 and the pressure member 47 make contact with each other for a long period of time can be avoided, and a situation in which the portions of the absorption member 46 and the pressure member 47 that make contact with each other stick to each other due to the ink adhering to the absorption surface 46*a* of the absorption member 46 can be suppressed. Furthermore, a situation in which the absorption member 46 becomes permanently deformed due to the pressure member 47 applying pressure to the absorption member 46 for long periods of time can be suppressed as well.

(4) The pressure member 47 is configured of a porous material and is held in a moist state by the cleaning liquid. Accordingly, when the pressure member 47 applies pressure to the absorption member 46, the cleaning liquid within the pressure member 47 is absorbed by the absorption member 46. The absorption member 46 can thus be held in an even moister state. Meanwhile, the ink that has been dispersed throughout the entirety of the absorption member 46 due to the pressure member 47 applying pressure to the absorption member 46 is absorbed into the pressure member 47, which is configured of a porous material and is held in a moist state by the cleaning liquid. A state in which the absorption surface 46*a* of the absorption member 46 becomes clogged can thus be avoided even more effectively.

The aforementioned embodiment may be changed to the embodiments described hereinafter as well.

In the embodiment, the pressurizing operations, whereby the pressure member 47 applies pressure to the absorption member 46, may be executed multiple times in the state after the tip portion 32*a* of the wiper 32 has been cleaned by the absorption member 46. Through this, ink that has adhered to the absorption surface 46*a* of the absorption member 46 can be more easily dispersed into the absorption member 46 configured of a porous material held in a moist state by the cleaning liquid, as opposed to when the pressurizing operations that apply pressure to the absorption member 46 and cause the absorption member 46 to deform are executed by the pressure member 47 only once.

Although the pressurizing operations through which the pressure member 47 applies pressure to the absorption member 46 are performed after the tip portion 32*a* of the wiper 32 has been cleaned by the absorption member 46 in the above embodiment, the invention is not limited thereto, and the pressurizing operations may be carried out, for example, when the printer 11 is turned on.

Although the pressure member 47 is configured of a porous material and is held in a moist state by the cleaning liquid in the above embodiment, the invention is not limited thereto, and the pressure member 47 may be, for example, a plate-shaped member configured of plastic, a metal, or the like.

In the embodiment, a roller-shaped pressure member may be disposed in the maintenance unit 24 and that pressure member may be configured so as to be rotatable, rather than providing a plate-shaped pressure member 47. In this case, when applying pressure to the absorption member 46 using the pressure member, pressure is applied to the absorption member 46 while rotating the pressure member, and there is thus a risk that the cleaning liquid that holds the absorption member 46 is a moist state can be squeezed out by the pressure member. Accordingly, it is preferable to provide the maintenance unit 24 with a receptacle for receiving the squeezed-out cleaning liquid, and to provide a mechanism for returning the cleaning liquid that has accumulated in the receptacle to the absorption member 46.

Although the pressure member 47 is described in the embodiment as being in the non-pressure position, standing by in a state separated from the absorption member 46, when the pressurizing operations performed after the tip portion 32*a* of the wiper 32 has been cleaned by the absorption member 46 are not being carried out, the invention is not limited thereto. For example, the pressure member 47 may stand by in a state in which the pressure member 47 makes contact with the absorption member 46 after the pressurizing operations, performed after the tip portion 32*a* of the wiper 32 has been cleaned by the absorption member 46, have been carried out.

Although the embodiment describes the pressure member 47 as being supported by the support member 48 and the configuration as such that the support member 48 can be elevated and dropped by the elevating mechanism 49 independent from the other components, the invention is not limited thereto. For example, the pressure member 47 may be provided integrally with an elevation device that elevates and drops the cap, so that the pressure member 47 elevates integrally with the cap based on the driving of the elevation device, thereby applying pressure to the absorption member 46. In other words, the stated pressurizing operations may be executed in synchronization with the cleaning operations, whereby the space within the cap is depressurized through the driving of the suction pump in a state where the cap makes contact with the nozzle formation surface 21*a* of the recording head 21 so as to surround the nozzle 21*b*, thereby sucking and expelling ink from the nozzles 21*b*.

Although a non-volatile liquid is used to put the absorption member 46 and pressure member 47 in a moist state in the embodiment, the invention is not limited thereto, and a volatile liquid, for example, may be used as well.

Although a specific embodiment of the invention has been described using an ink jet printer used for printing as an example, the invention is not limited thereto, and the invention may be applied to a liquid ejecting apparatus that ejects a different liquid aside from ink (with the exception of gases). "Droplet" refers to the state of the liquid ejected from the liquid ejecting apparatus, and is intended to include granule forms, teardrop forms, and forms that pull tails in a string-like form therebehind. Furthermore, the "liquid" referred to here can be any material capable of being ejected by the liquid ejecting apparatus. For example, any matter can be used as long as the matter is in its liquid state, including liquids having high or low viscosity, sol, gel water, other inorganic agents, inorganic agents, liquid solutions, liquid resins, and fluid states such as liquid metals (metallic melts); furthermore, in addition to liquids as a single state of a matter, liquids in which the molecules of a functional material composed of a solid matter such as pigments, metal particles, or the like are dissolved, dispersed, or mixed in a liquid carrier are included as well. Ink, described in the above embodiment as a representative example of a liquid, liquid crystals, or the like can also be given as examples. Here, "ink" generally includes water-based and oil-based inks, as well as various types of liquid compositions, including gel inks, hot-melt inks, and so on. The following are specific examples of liquid ejecting apparatuses: liquid ejecting apparatus that eject liquids including materials such as electrode materials, coloring materials, and so on in a dispersed or dissolved state for use in the manufacture and so on of, for example, liquid-crystal displays, EL (electroluminescence) displays, surface emission displays, and color filters; liquid ejecting apparatuses that eject bioorganic matters used in the manufacture of biochips; liquid ejecting apparatuses that eject liquids to be used as samples for precision pipettes; printing equipment and microdispensers; and so on. Furthermore, the invention may be employed in liquid ejecting apparatuses that perform pinpoint ejection of lubrication oils into the precision mechanisms of clocks, cameras, and the like; liquid ejecting apparatuses that eject transparent resin liquids such as ultraviolet light-curable resins onto a substrate in order to form miniature hemispheric lenses (optical lenses) for use in optical communication elements; and liquid ejecting apparatus that eject an etching liquid such as an acid or alkali onto a substrate or the like for etching. The invention can be applied to any type of these liquid ejecting apparatuses.

The entire disclosure of Japanese Patent Application No. 2009-077009, filed Mar. 26, 2009 is expressly incorporated by reference herein.

What is claimed is:

1. A liquid ejecting apparatus comprising:

a liquid ejecting head including a nozzle formation surface in which a nozzle that discharges a liquid is formed;

a cleaning member that wipes the nozzle formation surface in order to remove liquid that has adhered to the nozzle formation surface, wherein the cleaning member is located on a first support member and is movable by a first movement mechanism that moves the cleaning member across the nozzle formation surface in a first direction;

an absorption member, configured of a porous material capable of deforming under pressure, having an upper surface fixed to a fixing surface or a fixing member and a lower surface as an absorption surface that makes contact with the cleaning member as the cleaning member moves in the first direction along the absorption surface in order to absorb liquid that has adhered to the cleaning member;

a pressure member capable of moving between a pressure position, in which the pressure member applies pressure to the absorption surface of the absorption member, and a non-pressure position, in which the pressure member cannot apply pressure to the absorption surface of the absorption member, wherein the pressure member has a pressure surface that is able to cover the absorption surface;

a second movement mechanism that moves the pressure member from the non-pressure position toward the pressure position that becomes a direction toward the fixing surface or the fixing member, following passing of the cleaning member past the absorption member in the first direction, so as to cause the absorption member to deform with the absorption surface covered with the pressure surface such that the liquid absorbed by the absorption member from the cleaning member via the absorption surface disperses into the interior of the absorption member; and a control unit configured to independently drive the first movement mechanism to move the cleaning member in the first direction and the second movement mechanism to elevate and drops the pressure member towards the fixing surface or the fixing member.

2. The liquid ejecting apparatus according to claim 1, wherein the interior of the absorption member is held in a moist state by a cleaning liquid.

3. The liquid ejecting apparatus according to claim 2, wherein the cleaning liquid is a non-volatile liquid.

4. The liquid ejecting apparatus according to claim 1, wherein the pressure member stands by in the non-pressure position, separated from the absorption member, other than when a pressurizing operation in which the movement mechanism moves the pressure member from the non-pressure position toward the pressure position in order to apply pressure to the absorption member is carried out.

5. The liquid ejecting apparatus according to claim 1, wherein the pressure member is configured of a porous material whose interior is held in a moist state by the cleaning liquid.

6. The liquid ejecting apparatus according to claim 1, wherein a pressurizing operation in which the second movement mechanism moves the pressure member from the non-pressure position toward the pressure position in order to apply pressure to the absorption member is executed multiple times.

7. The liquid ejecting apparatus according to claim 1, wherein the pressure member is a plate member.

8. The liquid ejecting apparatus according to claim 1, wherein a height of the absorption surface is the same as a height of the nozzle formation surface in a state that the nozzle formation surface is wiped by the cleaning member.

9. The liquid ejecting apparatus according to claim 1, wherein the second movement mechanism includes a second support member that is not in contact with the first support member, does not move the cleaning member, and wherein the pressure member is located on the second support member such that the pressure member is able to apply the pressure to the absorption member while in the pressure position after the absorption member has contacted the cleaning member.

10. The liquid ejecting apparatus according to claim 1, wherein the first movement mechanism moves the cleaning member across the absorption member along the absorption surface with the absorption surface making contact with the cleaning member such that the liquid that has adhered to the cleaning member is absorbed to the absorption member.

11. The liquid ejecting apparatus according to claim 1, wherein the absorption surface of the absorption surface and the pressure surface of the pressure member are flat.

12. The liquid ejecting apparatus according to claim 1, further comprising a housing member having at least an upper wall as the fixing member, a side wall, and an opening adjacent the upper wall and opposite the side wall, and the pressure member is located within the housing member, wherein the first movement mechanism moves the cleaning member across the nozzle formation surface and into the housing via the opening.

* * * * *